US008919142B2

(12) United States Patent
Tippmann

(10) Patent No.: US 8,919,142 B2
(45) Date of Patent: Dec. 30, 2014

(54) SWING SEAL FOR A RACK-AISLE FREEZING AND CHILLING SYSTEM

(76) Inventor: Daniel J. Tippmann, Fort Wayne, IN (US)

( * ) Notice: Subject to any disclaimer, the term of this patent is extended or adjusted under 35 U.S.C. 154(b) by 789 days.

(21) Appl. No.: 13/074,098

(22) Filed: Mar. 29, 2011

(65) Prior Publication Data

US 2013/0263614 A1 Oct. 10, 2013

(51) Int. Cl.
*F24F 13/20* (2006.01)

(52) U.S. Cl.
USPC ..... 62/259.1

(58) Field of Classification Search
CPC . F25D 17/045; F25D 17/005; F25D 1717/06; F25D 3/12; F25D 17/065
USPC ..... 62/89, 187, 259.1, 240, 407, 426, 440, 62/62, 99, 265, 406, 419; 52/173.2, 234; 414/276; 99/476; 160/188, 207; 454/174
See application file for complete search history.

(56) References Cited

U.S. PATENT DOCUMENTS

| | | | | |
|---|---|---|---|---|
| 206,140 | A | 7/1878 | Rumbaugh | |
| 239,345 | A | 3/1881 | Sanford | |
| 677,536 | A | 7/1901 | Cooper | |
| 1,813,187 | A | 7/1931 | Moore | |
| 2,778,206 | A * | 1/1957 | Wilson et al. | 62/62 |
| 3,479,947 | A * | 11/1969 | Myers | 454/344 |
| 3,545,223 | A | 12/1970 | Elland | |
| 3,621,672 | A * | 11/1971 | Meredith | 62/237 |
| 3,638,450 | A | 2/1972 | Falk | |
| 4,063,432 | A | 12/1977 | Chaussy et al. | |
| 4,221,421 | A | 9/1980 | Bettker, Jr. et al. | |
| 4,425,768 | A | 1/1984 | Burns | |
| 4,474,020 | A * | 10/1984 | Freeman | 62/89 |
| 4,934,255 | A * | 6/1990 | McDonnell et al. | 454/174 |
| 5,054,291 | A | 10/1991 | Davis et al. | |
| 5,353,564 | A * | 10/1994 | Hansen | 52/407.1 |
| 5,575,714 | A * | 11/1996 | Rijs | 454/174 |

(Continued)

FOREIGN PATENT DOCUMENTS

| | | |
|---|---|---|
| FR | 2 871 222 | 12/2005 |
| WO | 2005/106356 | 11/2005 |
| WO | 2007/122334 | 11/2007 |

OTHER PUBLICATIONS

"Go Tarpless!", Thermal Technologies, Inc., 2004.

(Continued)

*Primary Examiner* — Mohammad M Ali
*Assistant Examiner* — Emmanuel Duke
(74) *Attorney, Agent, or Firm* — Faegre Baker Daniels LLP

(57) ABSTRACT

An automatically adjustable swing seal for a rack-aisle freezing and chilling system extends, for example, from the top horizontal frame member of a racking structure and defines an intake opening along with side seals and a bottom seal. The swing seal is positioned at a height such that a product stack having a top edge positioned at any point along the face of the swing seat creates a seal between the intake opening and the stack via the swing seal, the side seals, and the bottom seal. Thus, stacks of varying heights may automatically be accommodated. Further, the bottom edge of the swing seal may be beveled, such that if a product stack is not evenly stacked a portion of the uneven stacking will not catch against the swing seal when the stack is pulled away from the opening.

22 Claims, 17 Drawing Sheets

(56) References Cited

U.S. PATENT DOCUMENTS

| | | | | |
|---|---|---|---|---|
| 5,706,662 | A | 1/1998 | Van | |
| 5,778,557 | A | 7/1998 | Leavens | |
| 6,340,043 | B1 | 1/2002 | Paupardin | |
| 6,446,452 | B2 * | 9/2002 | Durham | 62/239 |
| 6,901,768 | B1 * | 6/2005 | Windecker | 62/407 |
| 7,017,366 | B2 | 3/2006 | Bottom | |
| 7,178,356 | B1 | 2/2007 | Lingelbach et al. | |
| 7,752,867 | B2 * | 7/2010 | Lehmann et al. | 62/419 |
| 7,832,218 | B2 | 11/2010 | Hawkins | |
| 8,459,180 | B2 | 6/2013 | Paupardin et al. | |
| 2006/0185528 | A1 | 8/2006 | Tippmann et al. | |
| 2006/0207284 | A1 | 9/2006 | Lehmann et al. | |
| 2006/0272350 | A1 | 12/2006 | Weeth | |
| 2007/0169503 | A1 | 7/2007 | Kikuchi et al. | |
| 2011/0107784 | A1 | 5/2011 | Tippmann et al. | |

OTHER PUBLICATIONS

"Thermal Tech Acquires Cool Care", Thermal Tech News, vol. 5, No. 1, Spring 2002.

"Planning and Engineering Data, Fish Freezing . . . ", Fisheries and Aquaculture Department, 1984.

* cited by examiner

SWING SEAL FOR A RACK-AISLE FREEZING AND CHILLING SYSTEM

BACKGROUND

1. Field of Invention

The present invention relates to a warehouse or structure that mass freezes and stores bulk foods and other products, and in particular to racking and chilling structures in the warehouse.

2. Description of Related Art

Two-stage freezer warehouses are known in which large pallets of items including meats, fruit, vegetables, prepared foods, and the like are frozen in blast rooms of a warehouse and then are moved to a storage part of the warehouse to be maintained at a frozen temperature until their removal. Such two-stage freezer warehouses require separate blast and storage rooms that encompass a relatively large amount of space.

U.S. patent application Ser. No. 12/877,392 entitled "Rack Aisle Freezing System for Palletized Product", filed on Sep. 8, 2010, relates to an improved system for freezing food products. Shown in FIG. 1 is a large warehouse 2 that is used to freeze and maintain perishable foods or like products. Large pallets of items, including meats, fruits, vegetables, prepared foods, and the like, are sent to warehouse 2 to be frozen employing a system whereby the palletized foods are frozen on storage racks.

FIG. 2 shows a top view of the interior of warehouse 2, in which rows of palleted product are shown such that pallets 4 abut chambers 6. As shown in FIG. 3, rows of racking 14 are positioned between aisles 10 and chambers 6. Each chamber 6 is enclosed by a pair of end walls 15 and top panel 17. Cold air produced in warehouse 2 is drawn through spacers 20 (FIGS. 5 and 6) separating rows of cases 22 of product on pallets 4, creating a palletized product stack which is disposed and sealed against the exterior of racking 14 (FIG. 3) via forklifts 18.

Chillers 8 (FIG. 2) provided in the interior of warehouse 2 produce the cold air and maintain the temperature of ambient air within the warehouse space at a level below freezing. A plurality of racking structures 14 (FIGS. 3 and 4) each define a plurality of adjacent air flow chambers 6 (FIGS. 2 and 4) having air intake openings on opposite sides thereof and a plurality of air outlets having air moving devices, such as exhaust fans 12, on top panels 17, which causes freezing air to be drawn into chambers 6 through intake openings and to then exhaust into the warehouse space. The plurality of airflow chambers 6 are each defined by a pair of end walls 15 and top wall 17 having one or more air outlets and exhaust fans associated therewith (FIG. 3). Pallets 4 on pallet guides are pressed against the intake openings such that a seal is formed between the pallets and the intake openings via side periphery seals, a bottom periphery seal, and atop periphery seal that is selectively adjustable via a vertically manually adjustable bracket to which the top periphery seal attaches. The seals together define each intake opening. Freezing air is drawn through air pathways 16 (FIGS. 2, 4, and 5) within the palletized product in a direction towards chamber 6 to thereby quickly freeze the product. As shown in FIG. 5, spacers 20 may be placed between rows of cases 22 of product to provide air pathways 24 through which air flow can enter chamber 6.

While the top periphery seal may be adjusted via the corresponding bracket, a manual adjustment is required before product stacks of varying heights my be disposed against the intake openings such that a seal is formed between the stacks and openings. What is desired is an improvement over the foregoing.

SUMMARY

The present disclosure provides an automatically adjustable swing seal that for the rack-aisle freezing and chilling system described above extends, for example, from the top horizontal frame member of a racking structure and defines an intake opening along with side seals and a bottom seal. The swing seal is positioned at a height such that a product stack having a top edge positioned at any point along the face of the swing seal creates a seal between the intake opening and the stack via the swing seal, the side seals, and the bottom seal. Thus, stacks of varying heights may automatically be accommodated. Further, the bottom edge of the swing seal may be beveled, such that if a product a stack is not evenly stacked, a portion of the uneven stacking will not catch against the swing seal when the stack is pulled away from the opening.

In one form thereof, the present disclosure provides an installation for chilling or freezing and cold storage of product stacks of palletized product, including a cold storage warehouse space, at least one chiller in the warehouse space that produces chilled or freezing air and maintains the temperature of ambient air in the warehouse space at chilled or below freezing, at least one air flow chamber including opposite walls, a plurality of air intake openings in at least one wall of the walls, and at least one air outlet having an associated air moving device for causing chilled or freezing air to be drawn into the chamber through the air intake openings and exhausted into the warehouse space through the air outlet, and swing seals disposed over respective air intake openings, each swing seal hingedly connected to the one wall via a hinge defining a horizontal axis about which the swing seal rotates. When stacks of product to be chilled or frozen are disposed in sealing engagement with the air intake openings against the swing seals, a top edge of each engaged product stack is disposed against a front panel of the swine seal to rotate the swing seal inward about said horizontal axis of the hinge such that the swing seal and peripheral walls defining the air intake opening create a seal between the engaged product stack and the air intake opening, and chilled or freezing air is drawn through the product stack to thereby quickly freeze the product.

In another form thereof, the present disclosure provides an installation for chilling or freezing and cold storage of palletized product, including a cold storage warehouse space, at least one chiller in the warehouse space that produces chilled or freezing air and maintains the temperature of ambient air in the warehouse space at chilled or below freezing, at least one air flow chamber including opposite walls, a plurality of air intake openings in at least one wall of the walls, and at least one air outlet having an associated air moving device for causing chilled or freezing air to be drawn into the chamber through the intake openings and exhausted into the warehouse space through the air outlet, and swing seals disposed over respective air intake openings, the swing seals extending forwardly of their respective air intake openings and being yieldably movable rearwardly toward the interior of the chamber. When product stacks to be frozen or chilled are disposed in sealing engagement with the air intake openings against the swing seals, the swing seals are pushed inwardly such that the swing seal and peripheral walls defining the air intake opening create a seal between the engaged product stack and the air intake opening, and chilled or freezing air is drawn through the product stack to thereby quickly freeze the product.

In yet another form thereof, the present disclosure provides an installation for chilling or freezing and cold storage of stacks of palletized product, the installation including a cold warehouse space cooled by a chiller and a chamber having a plurality of air intake openings in a wall thereof, a method for chilling or freezing the stacks of palletized product, including providing a swing seal over each of a plurality of intake openings, the seals extending forwardly of the respective openings and being yieldably movable rearwardly toward an interior of the chamber; moving a stack of palletized product against the periphery of one of the openings thereby contacting the respective swine seal and pushing the swing seal rearwardly such that the product stack is scaled against the periphery of the opening and the swing seal; and drawing chilled or freezing air through the product stack into the chamber and out of the chamber to thereby chill or freeze the product stack.

BRIEF DESCRIPTION OF THE DRAWINGS

The above-mentioned and other features and advantages of this disclosure, and the manner of attaining them, will become more apparent and the invention itself will he better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the disclosure in any manner.

DETAILED DESCRIPTION

Figure 1:
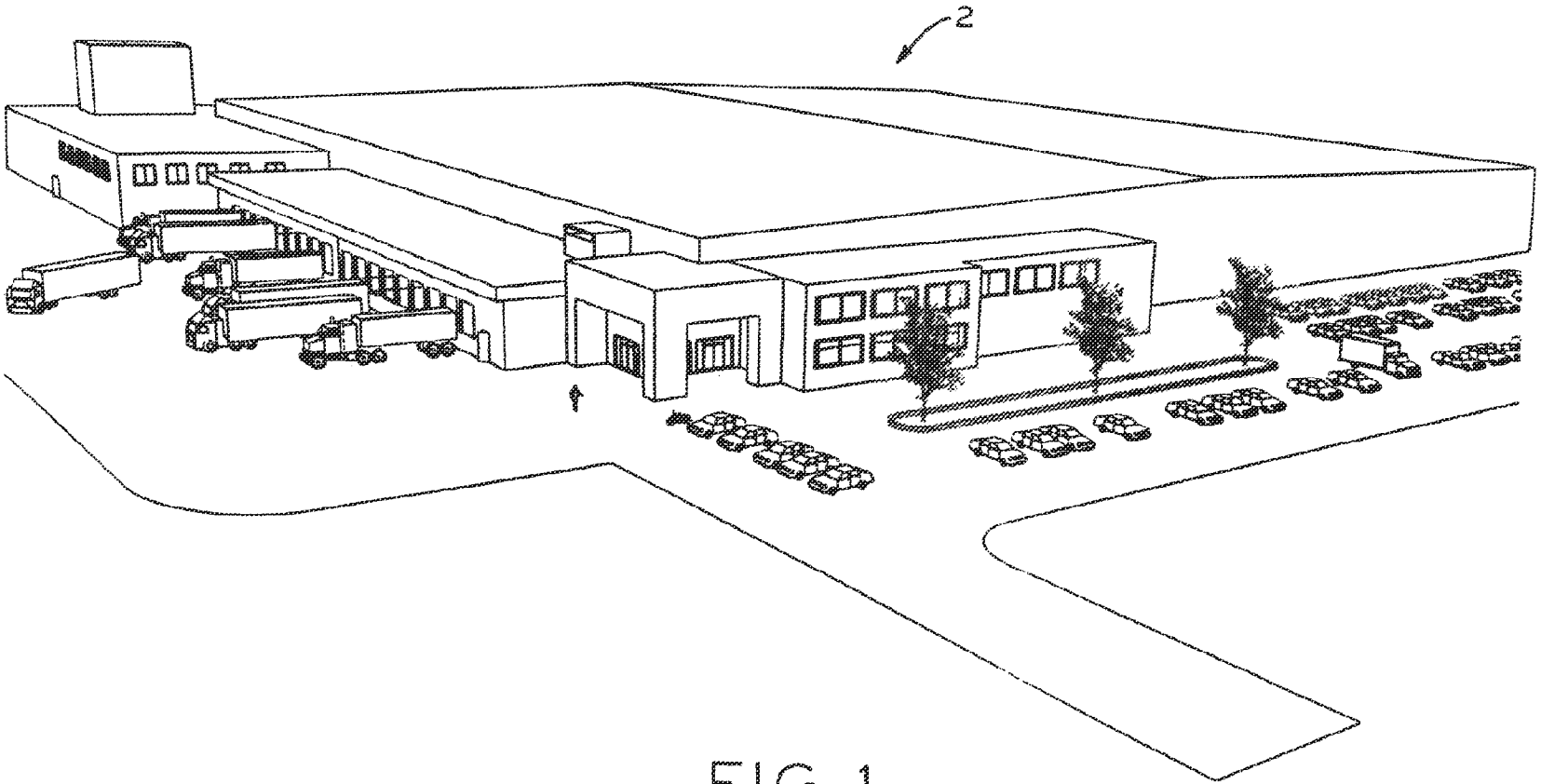
FIG. 1 is a perspective view of a warehouse incorporating a freezing system in accordance with the present disclosure.

An improved sealing system for an installation and method for chilling or freezing and cold storage of palletized product is disclosed herein. A chiller 8 provided in the interior of a cold storage warehouse 2 is used to maintain the temperature of ambient air within the space of the warehouse at a low level such as below freezing. A plurality of racking structures 14 each define a plurality of air flow chambers 6 each having walls with air intake openings on opposite sides thereof and an air outlet and fan 12 to enable freezing air to be drawn into the chamber through intake openings and exhausting into the warehouse space.

Figure 9:
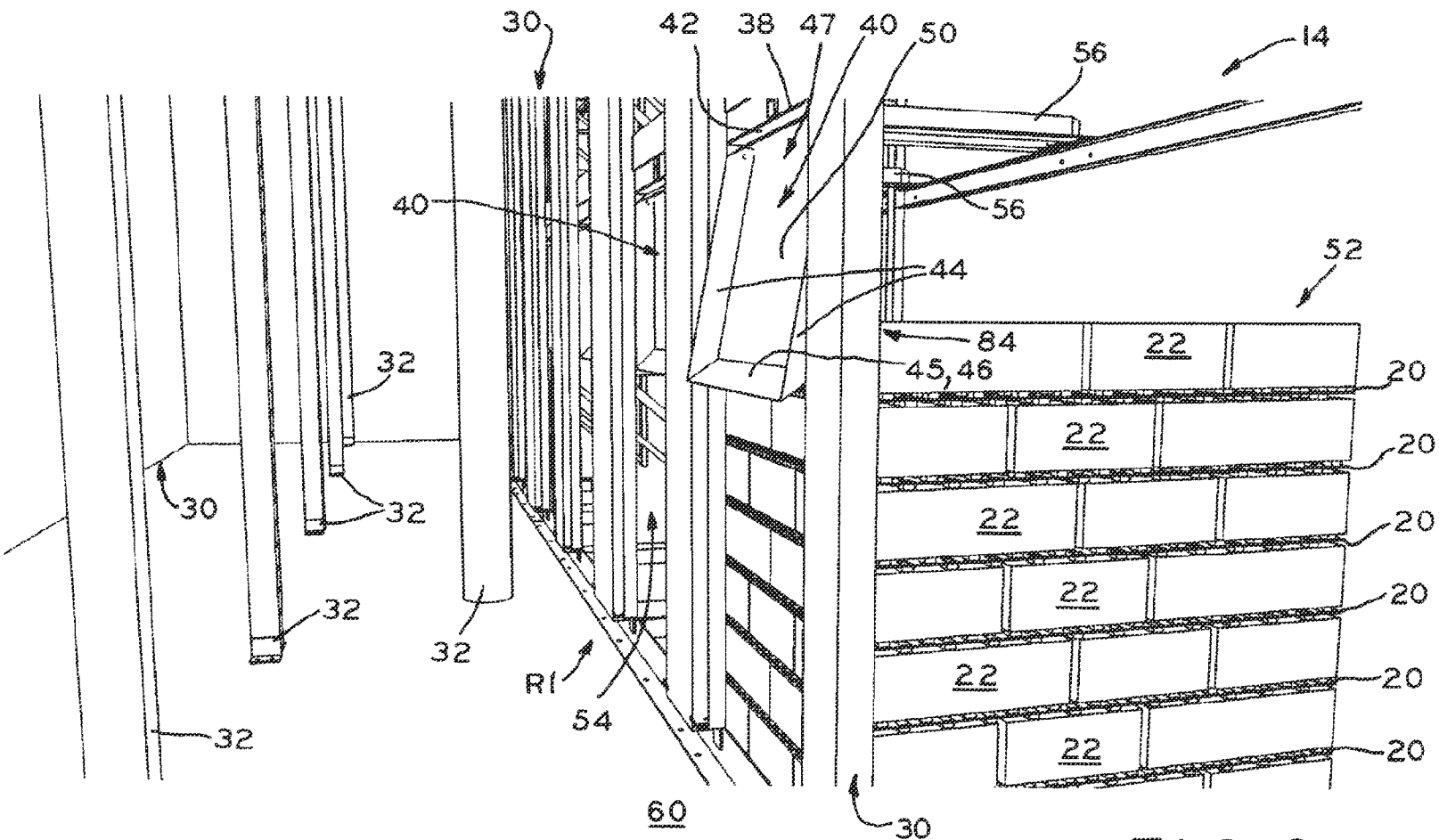
FIG. 9 is a perspective view of the racking structure with the palletized product disposed against the swing seal of FIG. 7 as seen from the interior air chamber.

As farther described below, palletized product stacks 52 on pallet guides 56 are pressed against the intake openings 54 such that a seal is formed between the palletized product stacks and the intake openings via side periphery seals, a bottom periphery seal, and an automatically adjustable top periphery swing seal, the seals together defining each intake opening 54. Chilling or freezing air is drawn through air pathways within the palletized product in a direction towards the chamber to thereby quickly freeze the product, which may then advantageously be stored on the same rack on which it is frozen, Referring to FIG. 6, racking structure 14 includes wall 30, which is one of a pair of walls 30 defining the exterior of racking structure 14. End walls 15 are disposed between the pair of walls 30 on opposite ends of racking structure 14. End walls 15, walls 30, and top panels 17 having exhaust fans 12 define interior chambers 6. Referring to FIG. 9, chambers 6 may include posts 32 of racking structure 14 to provide stabilizing support to the structure.

Figure 6:
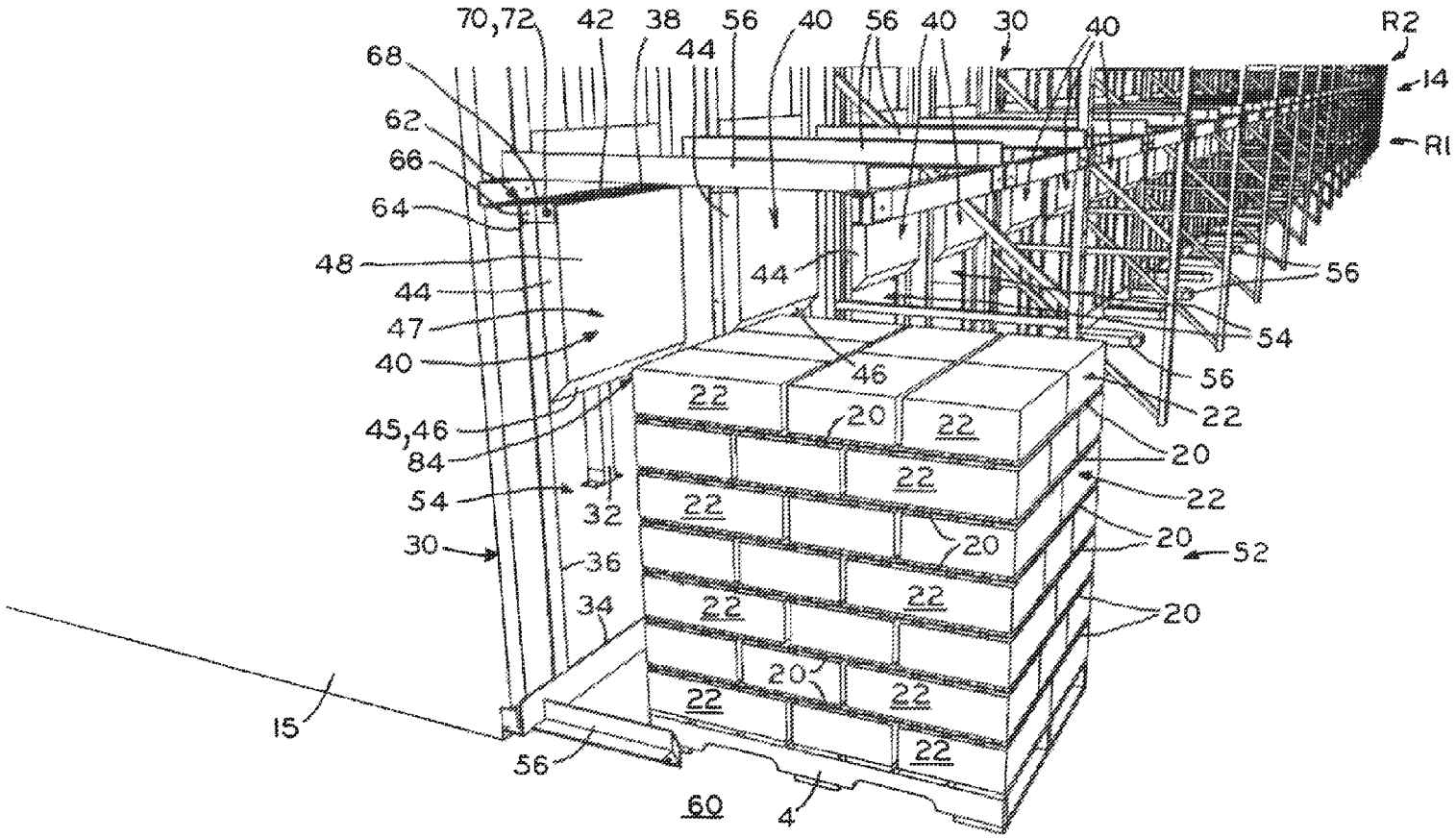
FIG. 6 shows loading of the palletized product into the racks.

Walls 30 are formed by interconnected vertical arid horizontal steel frame members which may define a plurality of openings. Referring to FIG. 6, each wall 30 of racking structure 14 includes bottom horizontal frame member 34 forming a lower seal, vertical frame members 36 that form a pair of side periphery seals 36, and top horizontal frame member 38. Frame members 34, 36, and 38 are preferably made of steel having flat faces but elastomeric material could be fastened to the front faces if desired. When product stack 52 is not disposed against wall 30, as shown in FIG. 6, swing seals 40 (described below), frame members/seals 34 and bottom horizontal frame member 34 define a series of intake openings 54 spaced along wall 30 of racking structure 14.

Support guides 56 assist to position product stacks 52 within separate bays along racking structure 14 and against individual bay intake openings 54 of wall 30. The product stacks described herein may be loaded along the empty bays of first row R1 and/or second row R2, Additional rows above the first and second rows for racking structure 14 are within the scope of this disclosure and may additionally include bays into which product stacks may be positioned and disposed against respective intake openings. Product stacks are positioned against empty bays having bay intake openings other either side of racking structure 14, such that each intake opening of racking structure 14 is covered by a product stack. Filler panels (not shown) are utilized to cover any intake openings against which a product stack is not disposed to create and maintain a sufficient negative pressure environment within internal chamber 6.

A product stack 52 may be disposed against an intake opening 54 of a wall 30 and pressed against a front panel 47 of a swing seal 40, as described below, at a level corresponding to the height of the product stack, such that product stacks of varying heights may be utilized with the swing seal described herein without requiring a manual adjustment of the swing seal for such varying product stacks. As further described below, the product stack 52 presses against and rotates the swing seal 40 inwardly towards chamber 6 until the product stack abuts the frame members 34, 36 of the wall and a seal is created between the product stack and the intake opening.

Swing seal 40 is disposed below top horizontal frame member 38 of wall 30. The swing seal may be made of a steel sheet, although other materials such as elastomeric materials may be used in desired. Swing seal 40 includes top panel 42, a pair of side panels 44 and bottom panel 45, which forms beveled bottom edge 46. Top panel 42, side panels 44, and bottom panel 45 of swing seal 40 are disposed around the periphery of front panel 47. Interior face 50 (FIG. 9) of front panel 47 faces towards the direction of chamber 6 and exterior face 48 (FIG. 6) of front panel 47 faces toward the product stack to be loaded. Further, side panels 44 define a thickness. When swing seal 40 is in an at rest position such that a product stack is not disposed against swing seal 40, face 48 of front panel 47 protrudes forwardly from wall 30 at a distance corresponding to or less than the thickness of side panels 44.

Figure 7:
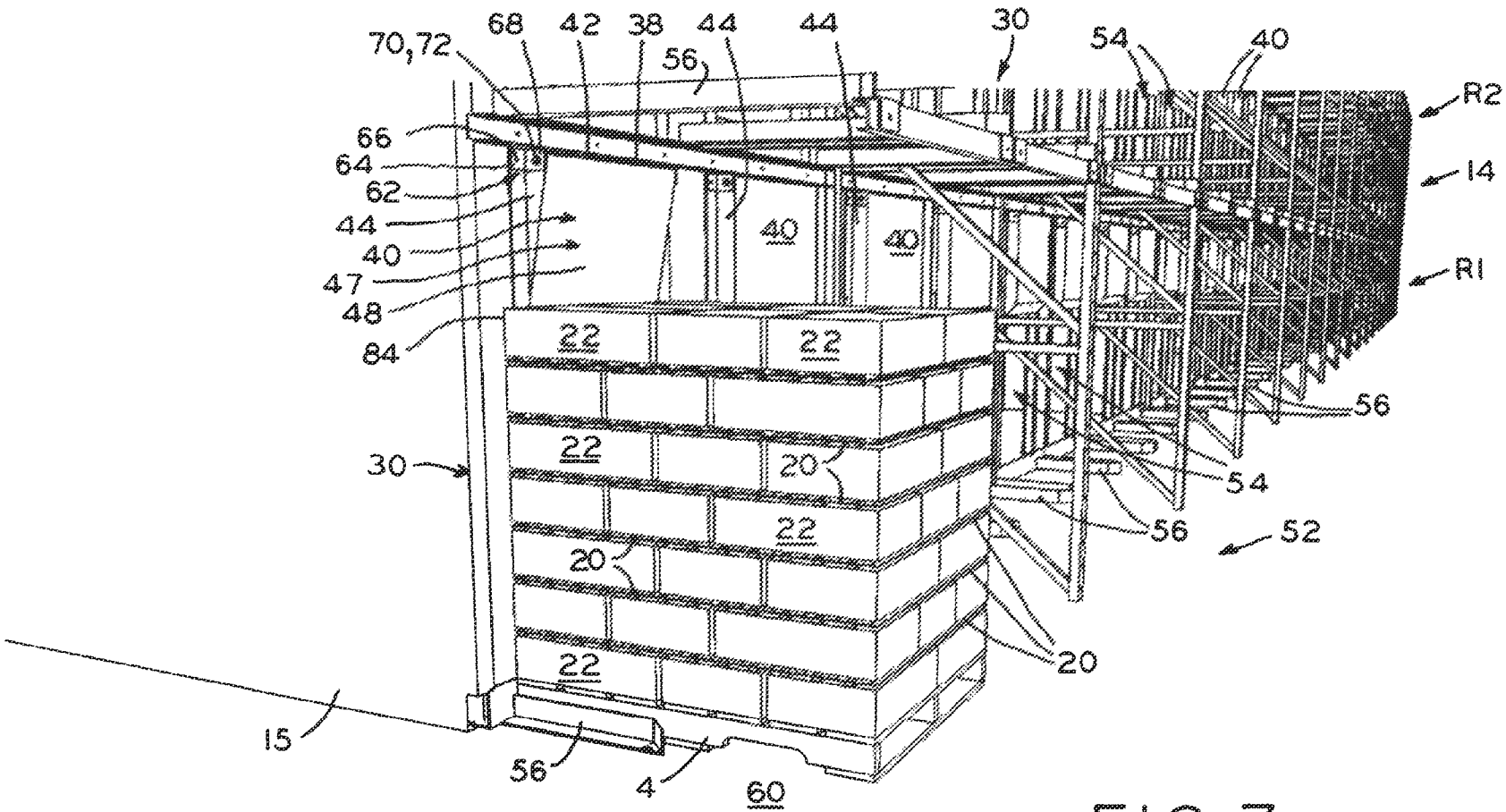
FIG. 7 shows the palletized product loaded into the racks and disposed against a swing seal of the racking.

Referring to FIG. 7, when product stack 52 is disposed against intake opening 54 of wall 30, swing seal 40 yieldably moves by pivoting rearwardly towards an interior of chamber 6 via rotating about a horizontal axis from a rest position to a seal position. Alternative designs of the swing seal may yieldably move rearwardly towards the interior of chamber 6 along a horizontal plane and, for example, against a spring biased three. In the seal position, as further described below, swing seal 40, the pair of side periphery seals 36, and bottom horizontal frame member 34 defining the lower seal create the seal between product stack 52 and intake opening 54.

Figure 10:
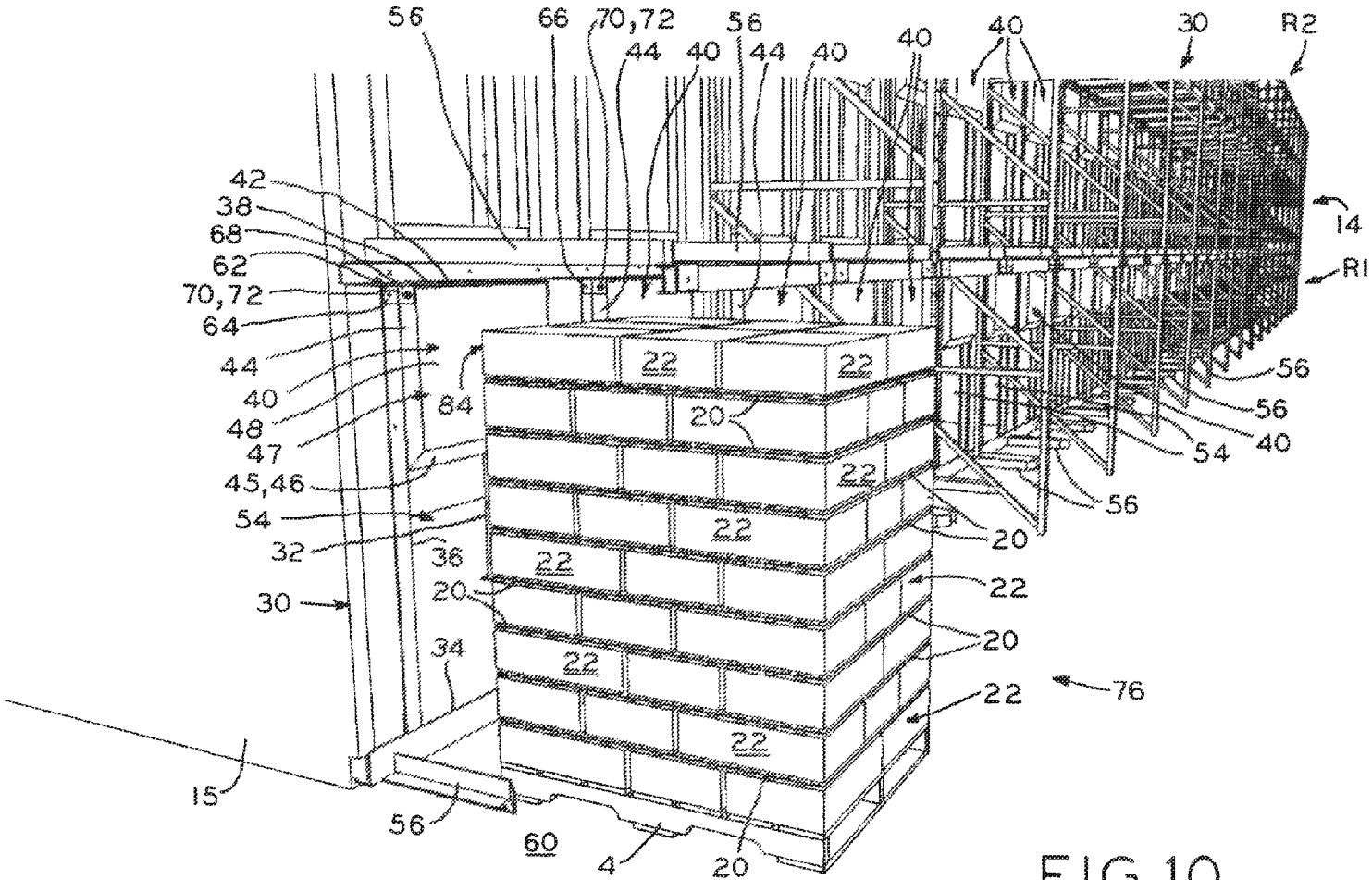
FIG. 10 shows loading of palletized product of an alternative height into the racks.

As mentioned above, the product stacks may vary in height, as shown by the different product stacks of FIGS. 6 and 10. For example, to cooperate with the swing seal of the present disclosure, the product stack may have a height ranging from a first height measured from floor 60 to just above bottom panel 45 of swing seal 40 to a second height measured from floor 60 to near the top portion of exterior face 48 of swing seal 40 that is at brackets 62 supporting swing seal 40, as discussed further below.

Figure 17:
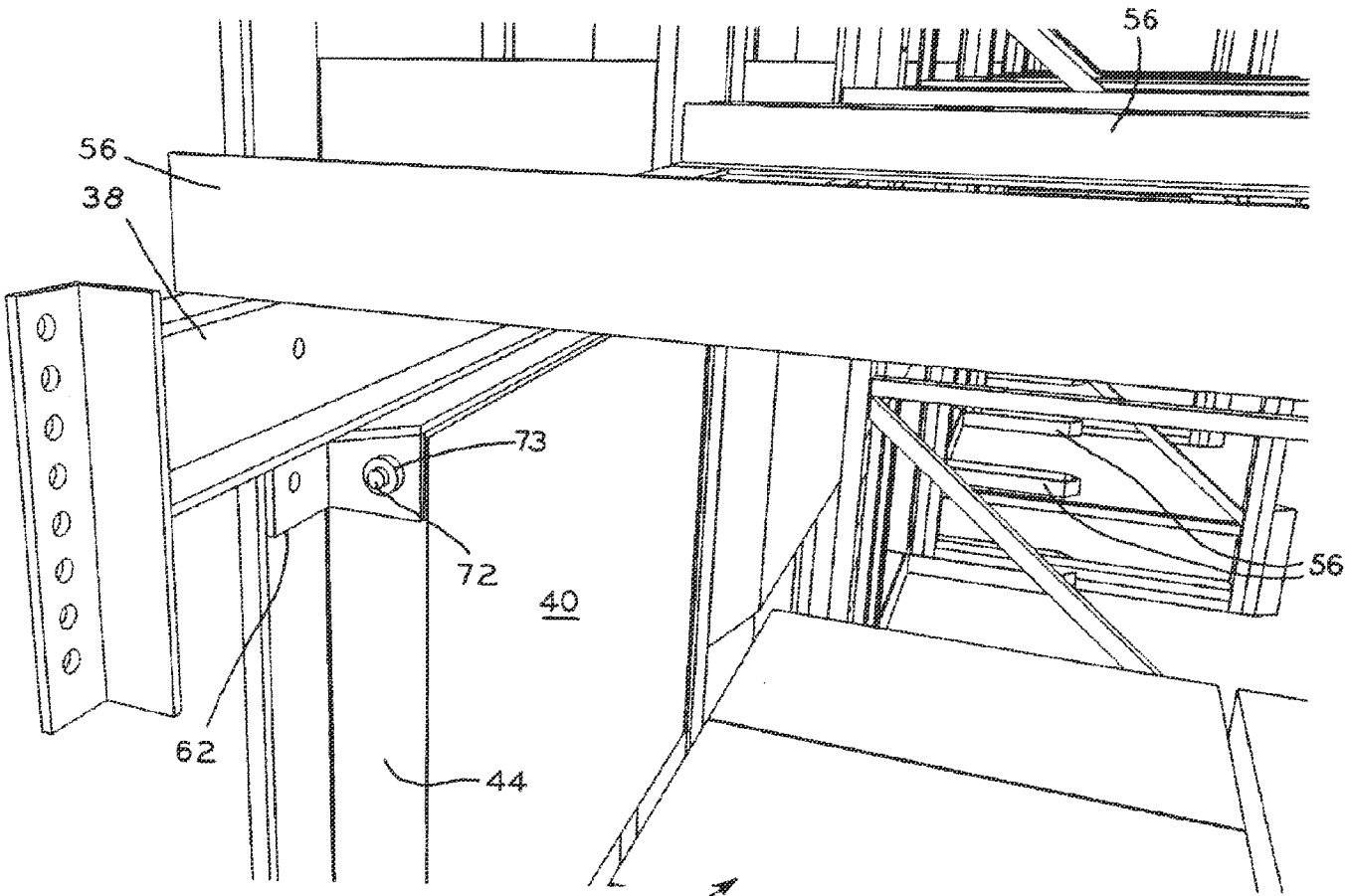
FIG. 17 is an enlarged perspective view showing the support for the swing seal.

The side panels 44 of swing seal 40 are attached to vertical frame members 36 of wall 30 via a pair of L-shaped brackets 62 such that swing seal 40 is rotatable about a horizontal axis, as described further below, Each bracket 62 includes legs 64 and 68. Leg 64 is attached to an upper portion of frame member 36 via a fastener, such as a bolt, that extends through aperture 66 of leg 64. Leg 68 is attached to an upper portion of side panel 44 of swing seal 40. Side panels 44 each include a rod aperture for receipt of rod 72. A hinge such as rod 72 extends through the pair of L-shaped brackets 52 and side panels 44 of swing seal 40 such that swing seal 40 can rotate about a horizontal pivot axis defined by rod 72, Particularly, rod 72 extends through the rod apertures of swing seal 40 and apertures 70 of legs 68 of brackets 62 on either side of swing seal 40 and is retained in place by means of a pair of locking collars 73 fastened to rod 72 by set screws (not shown) as shown in FIG. 17, As rod 72 defines the horizontal axis, swing seal 40 may rotate about the horizontal axis inwards towards chamber 6.

Figure 8:
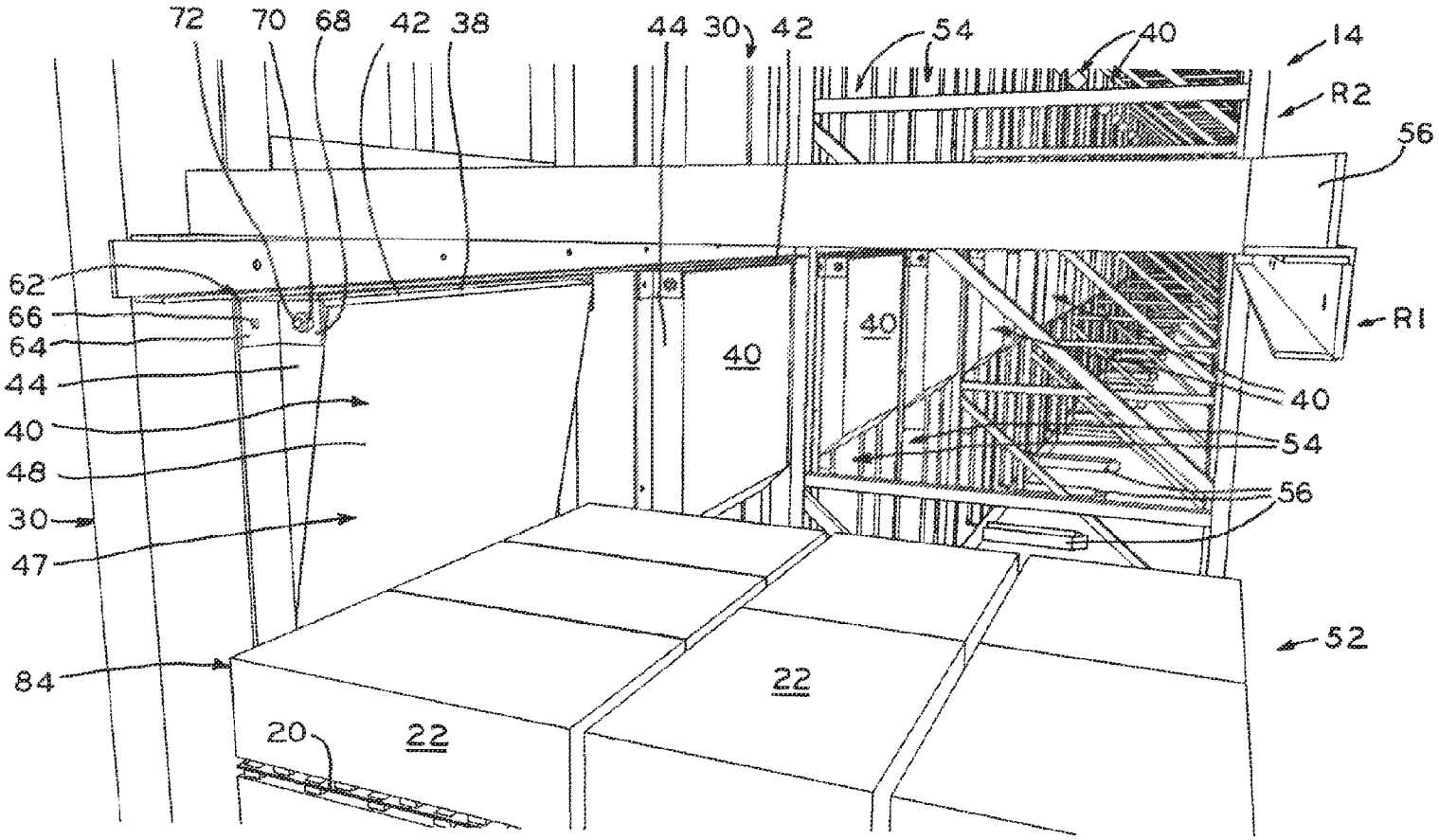
FIG. 8 is an enlarged fragmentary view showing the palletized product disposed against the swing seal of FIG. 7.

Referring to FIG. 7, as product stack 52 is placed or disposed against opening 54 as described above, a top corner of product stack 52 is pressed against face 48 of swing seal 40 (Fig, 8) to move swing seal 40 from the rest position to the seal position. Referring to FIG. 8, swing seal 40 is rotated about a horizontal axis of rod 72 (FIG. 9) until product stack 52 abuts side periphery seals 36 and lower seal 34 of wall 30, at which point swing seal 40 is in the seal position. In the seal position, the area of exterior face 48 of swing seal 40 seals against the top edge 84 of product stack 52. Exterior face 48 along with side panels 44 of swing seal 40 and seals 36 and 34 restrict the passage of air to chamber 6 outside of air being directed through spacers between cases on the product stack 52. as described below.

Figure 2:
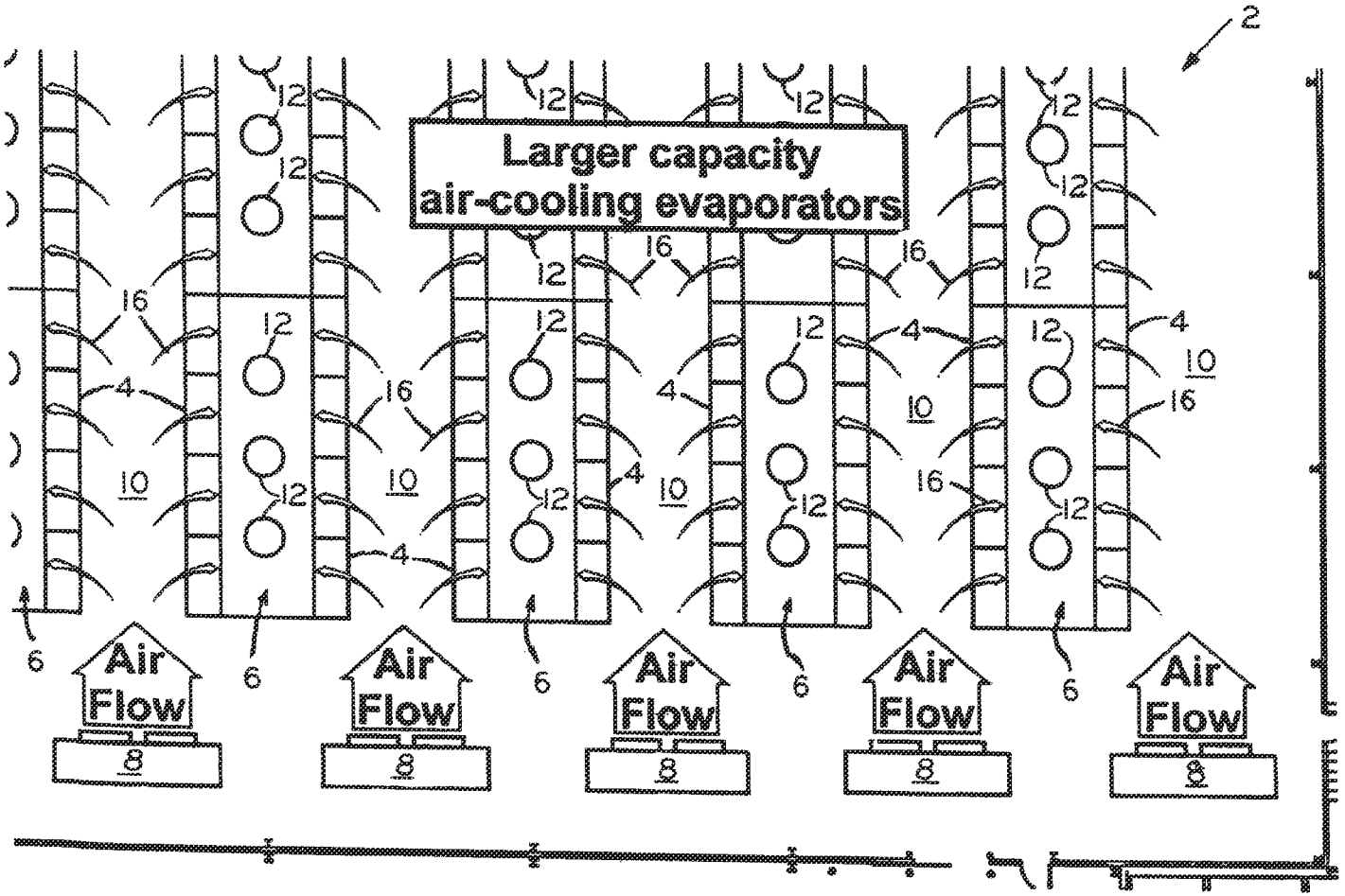
FIG. 2 is a diagrammatic top view of a freezer warehouse incorporating the system of the present disclosure.
Figure 3:
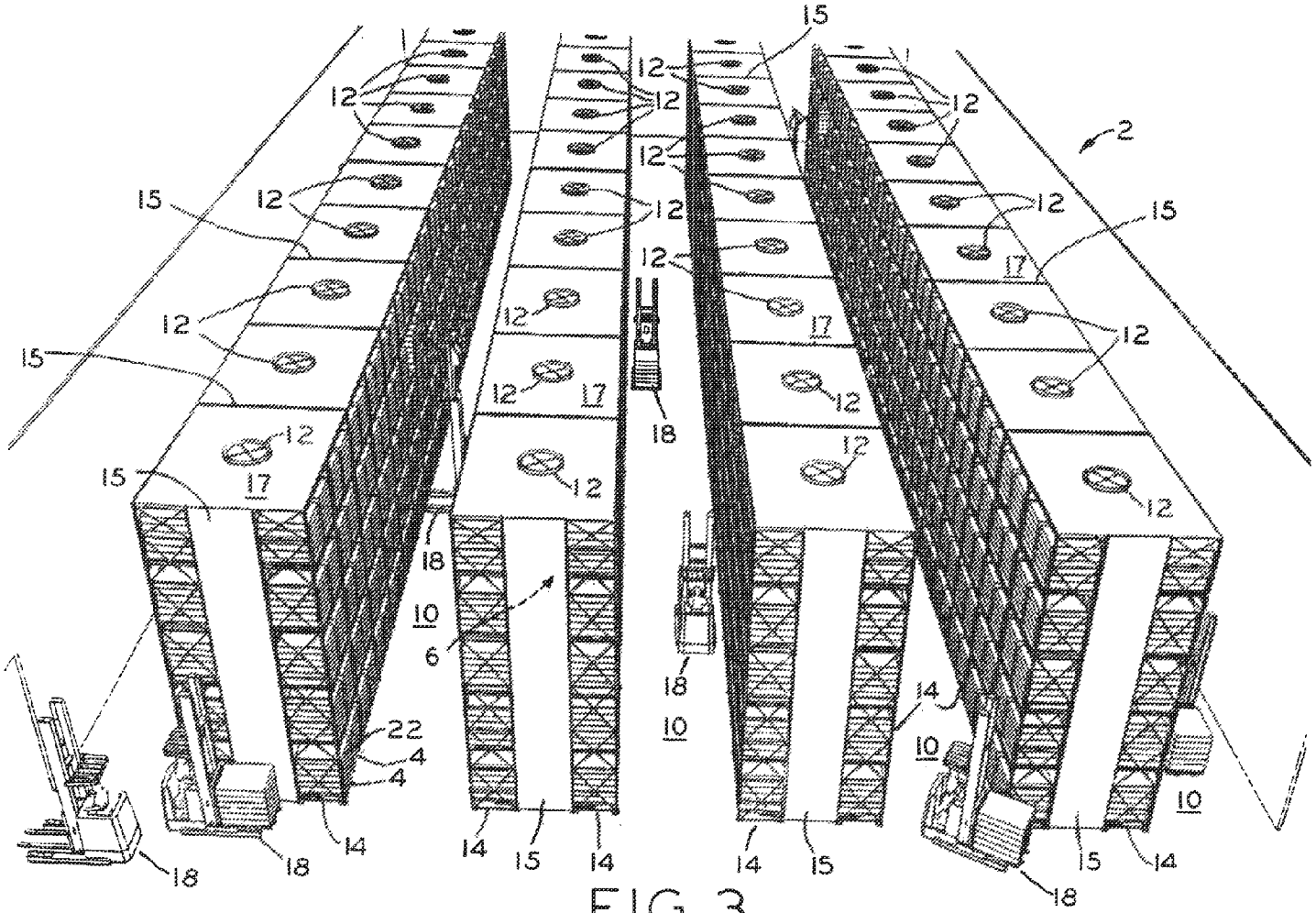
FIG. 3 is a perspective view of the interior of the freezer warehouse.
Figure 4:
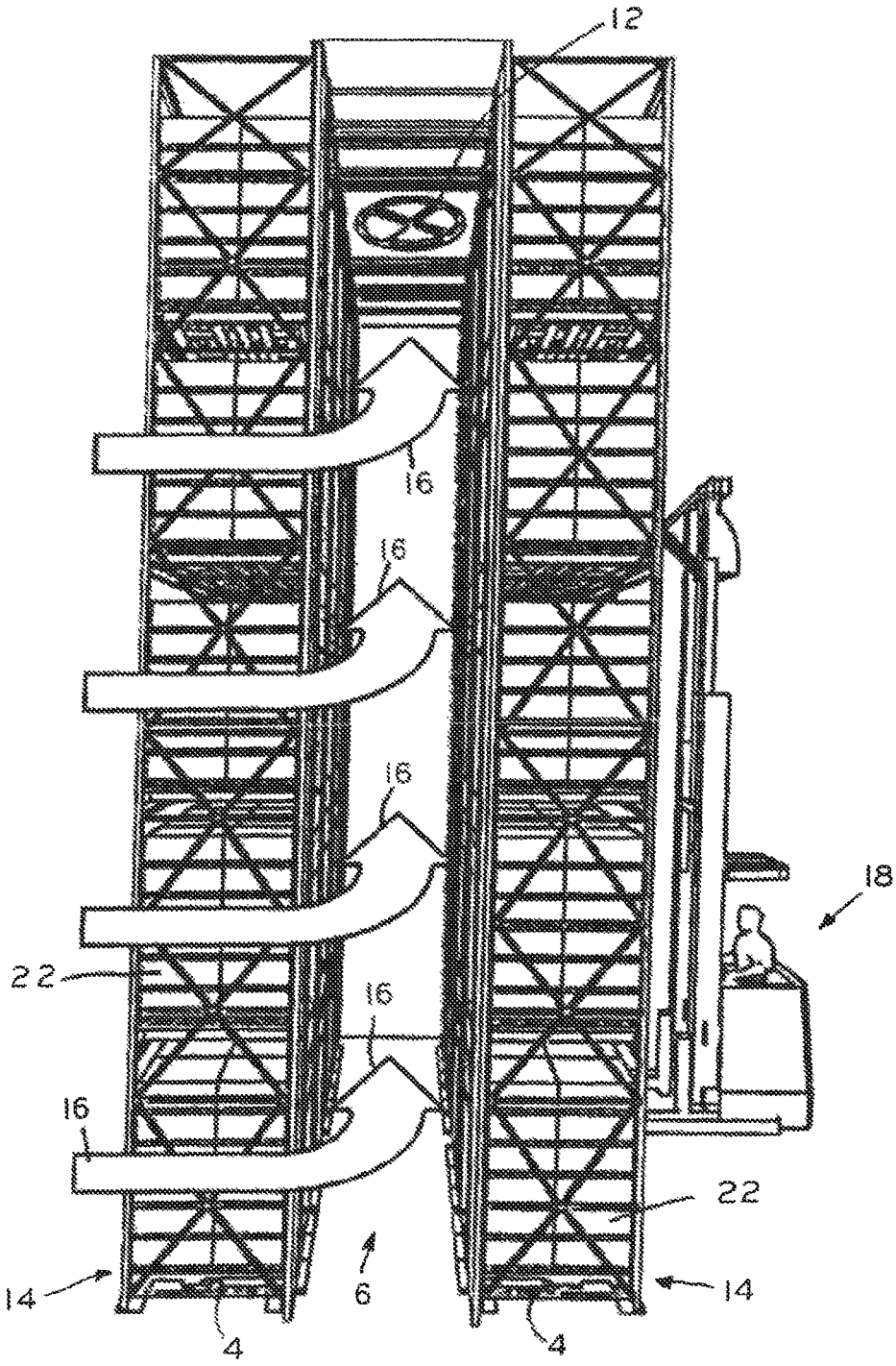
FIG. 4 is a perspective end view of two rows of racking.
Figure 5:
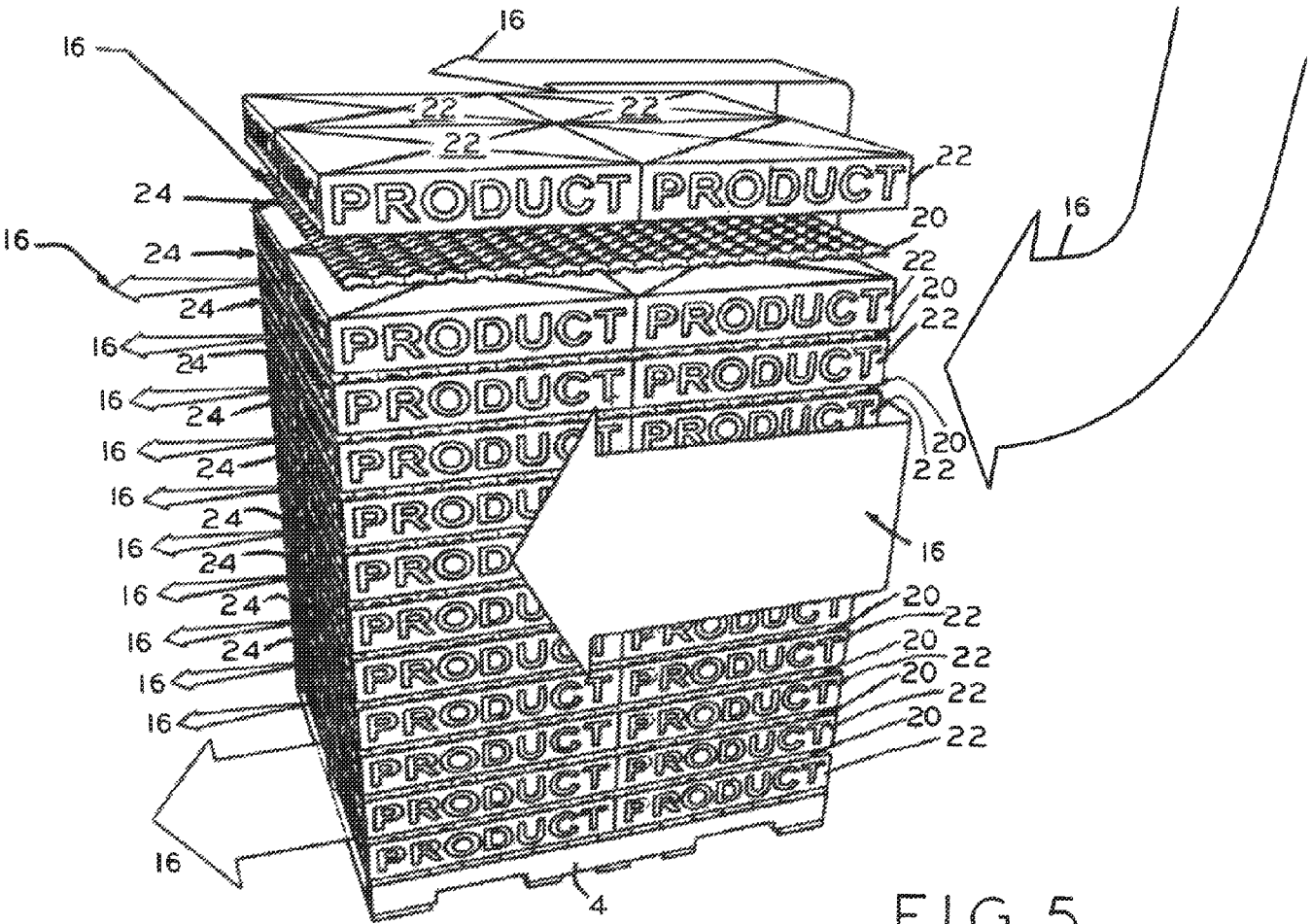
FIG. 5 is a diagrammatic perspective view showing the flow of chilling air through the palletized product.

Referring back to FIG. 7, chilled air is drawn into chamber 6 via product stack 52. Product stack 52 includes cases 22 positioned on pallet 4. Cases 22 are separated by spacers 20 such that, when product stack 52 is placed or disposed against wall 30, air is drawn through spacers 20 (FIG. 5), and/or through openings in the product boxes 22, through intake opening 54 (FIG. 6) into chamber 6 and exhausted through chamber 6 via exhaust openings such as fans 12 within top panel 17, The air drawn through spacers 20 is chilled sub-freezing air circulated by chillers 8 (FIG. 2). The chilled air is capable of freezing product of product stack 52 when drawn through spacers 20 and maintaining the product at the frozen temperature.

Figure 11:
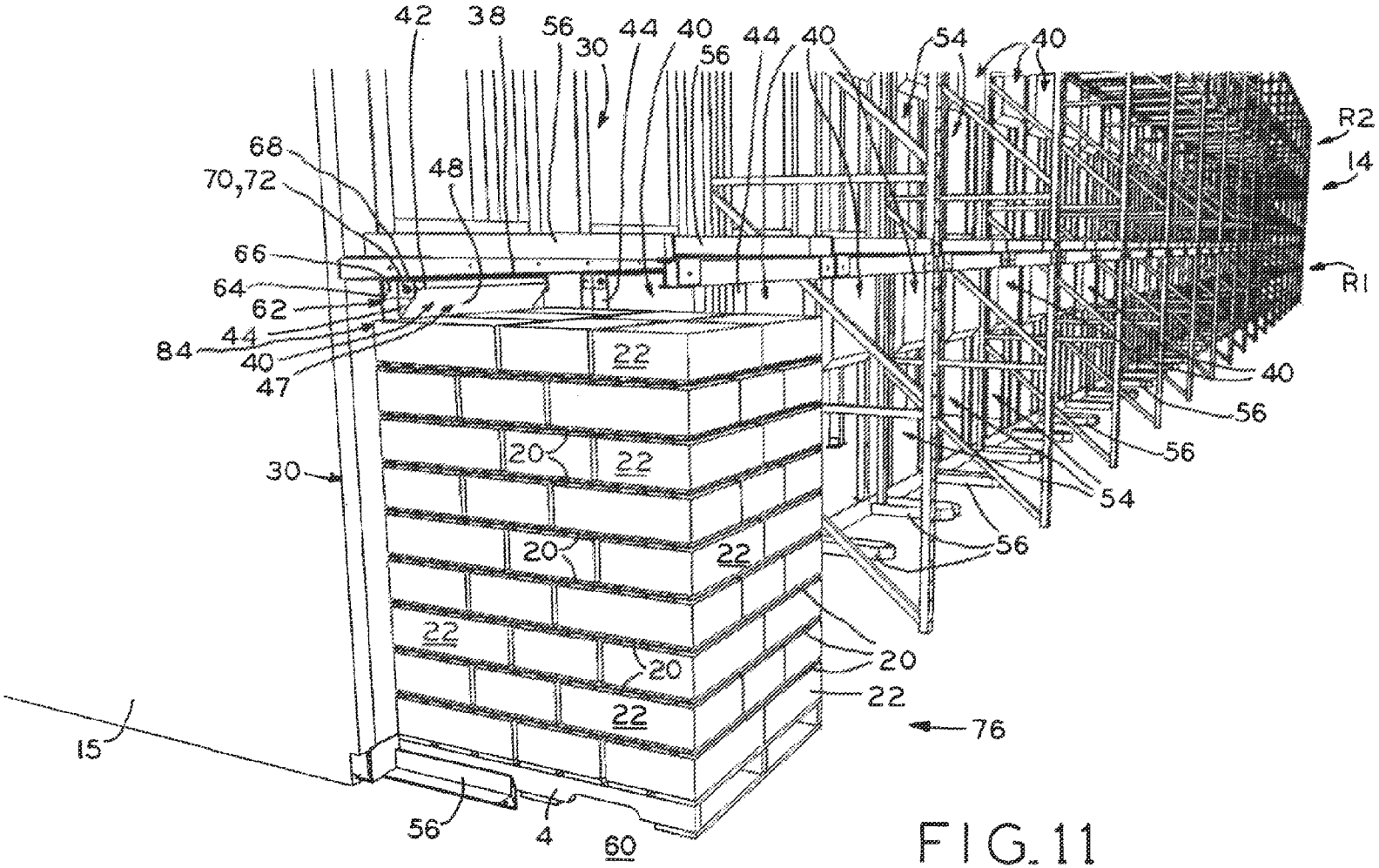
FIG. 11 shows the palletized product of FIG. 10 loaded into the racks and disposed against a swing seal of the racking.
Figure 12:
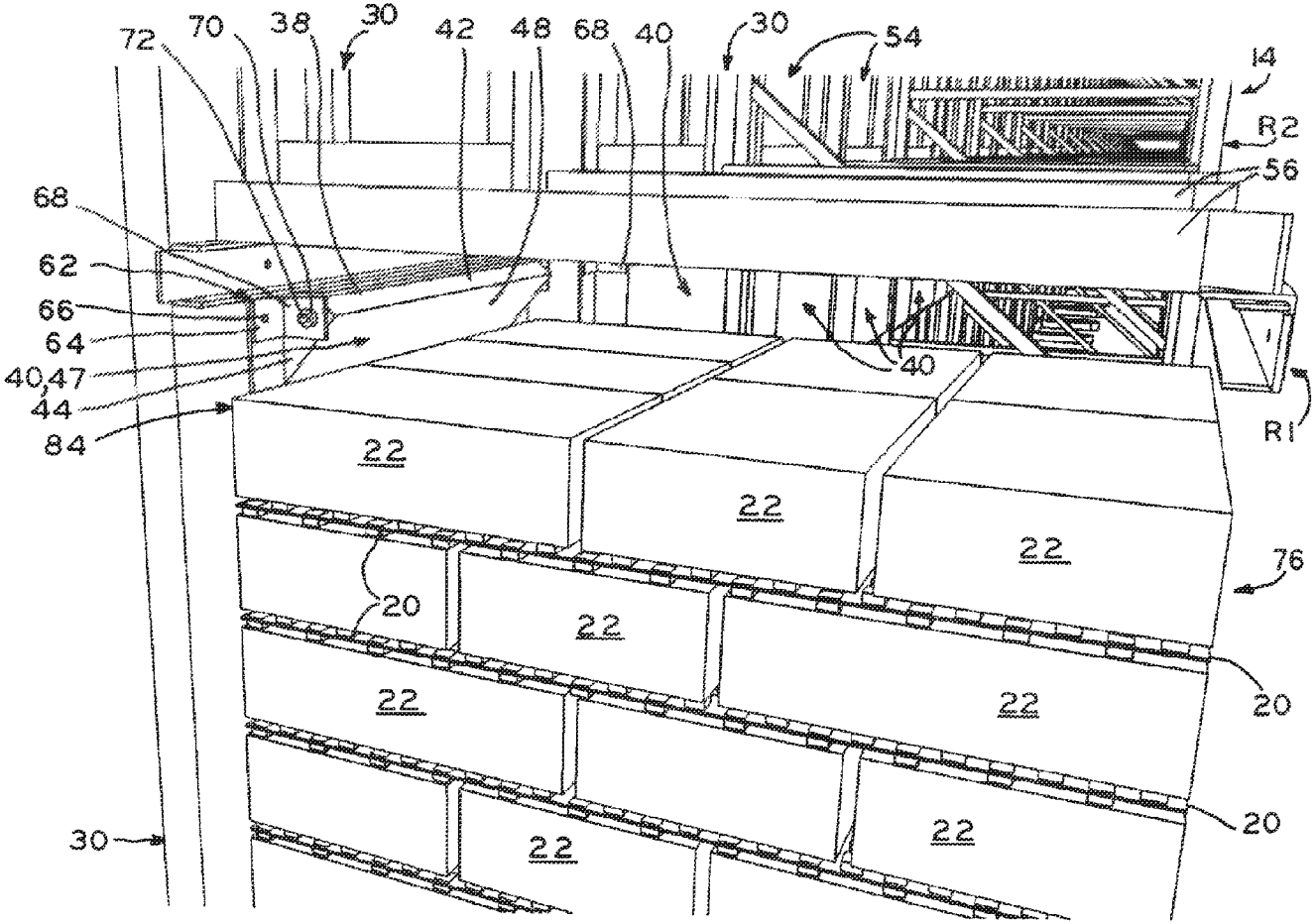
FIG. 12 is a fragmentary view showing the palletized product disposed against the swing seal of FIG. 11.
Figure 13:
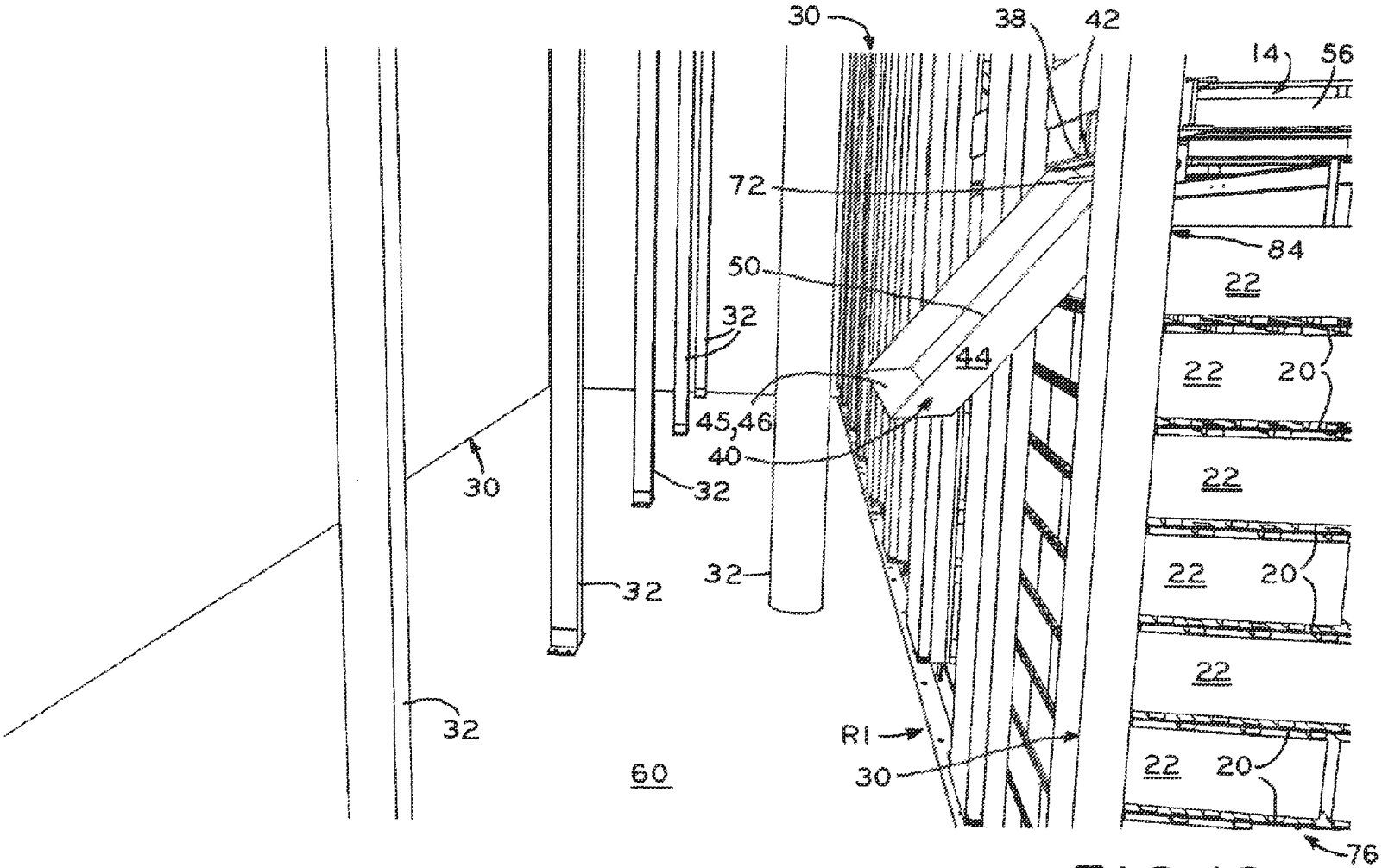
FIG. 13 is a perspective view of the racking structure with the palletized product of FIG. 10 disposed against the swing seal of FIG. 11 as seen from the interior air chamber.

FIGS. 10-13 show the method described above of positioning a product stack against intake opening 54 with product stack 76 having an alternative height that is higher than product stack 52 shown in FIGS. 6-9, Referring to FIG. 11 as product stack 76 is placed or disposed against wall 30 as described above, a top edge 84 of product stack 76 presses against face 48 of swing seal 40. Swing seal 40 is then rotated about a horizontal axis defined by rod 72 inwards towards chamber 6 to a sealed position, as described above (FIG. 13).

Figure 14:
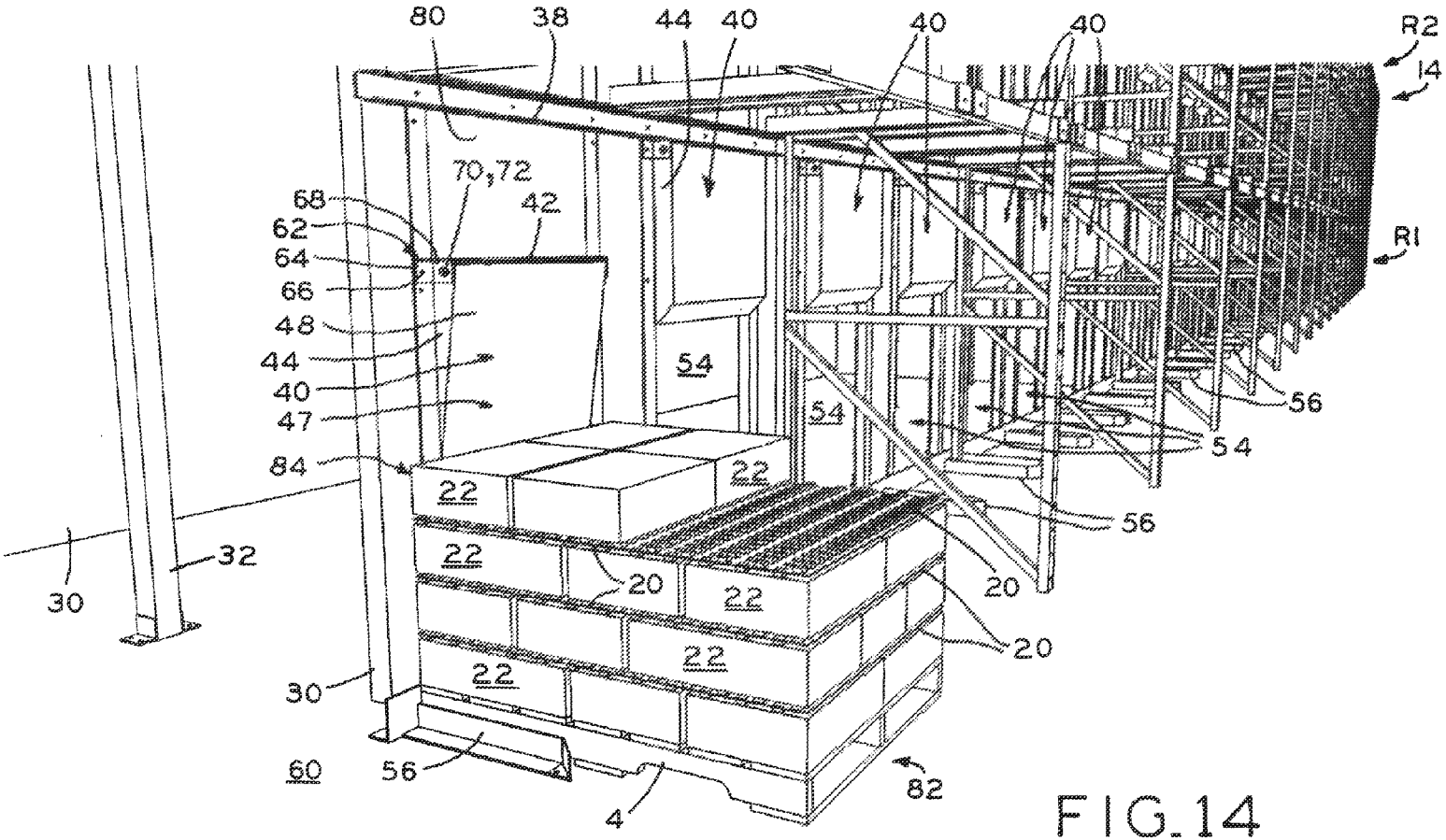
FIG. 14 shows palletized product of an another alternative height loaded into the racks and disposed against a swing seal of the racking, the swing seat disposed beneath a filler panel that seals a portion of an opening of the racking.
Figure 15:
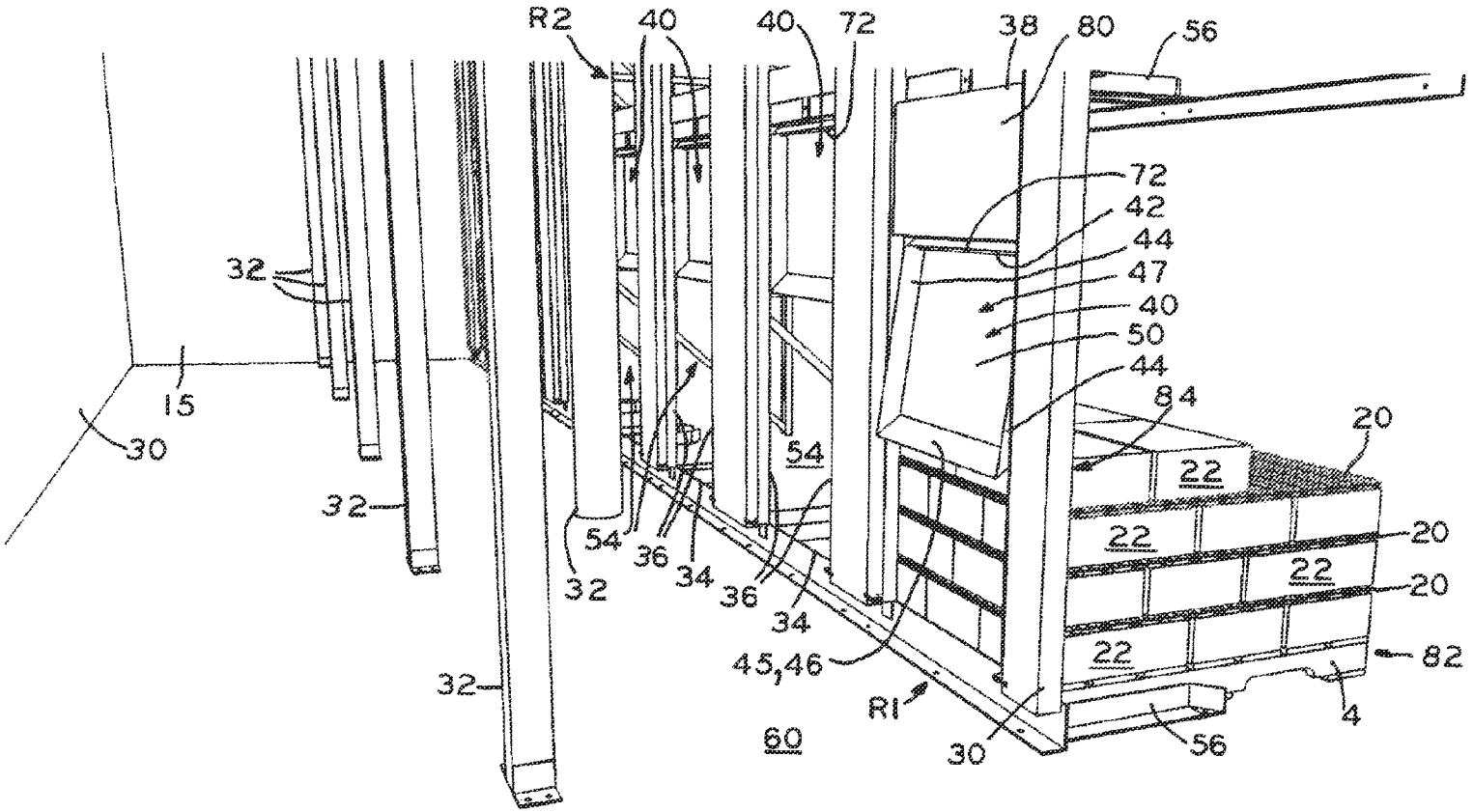
FIG. 15 is a perspective view of the racking structure with the palletized product of FIG. 14 disposed against the swing seal of FIG. 14 as seen from the interior air chamber.
Figure 16:
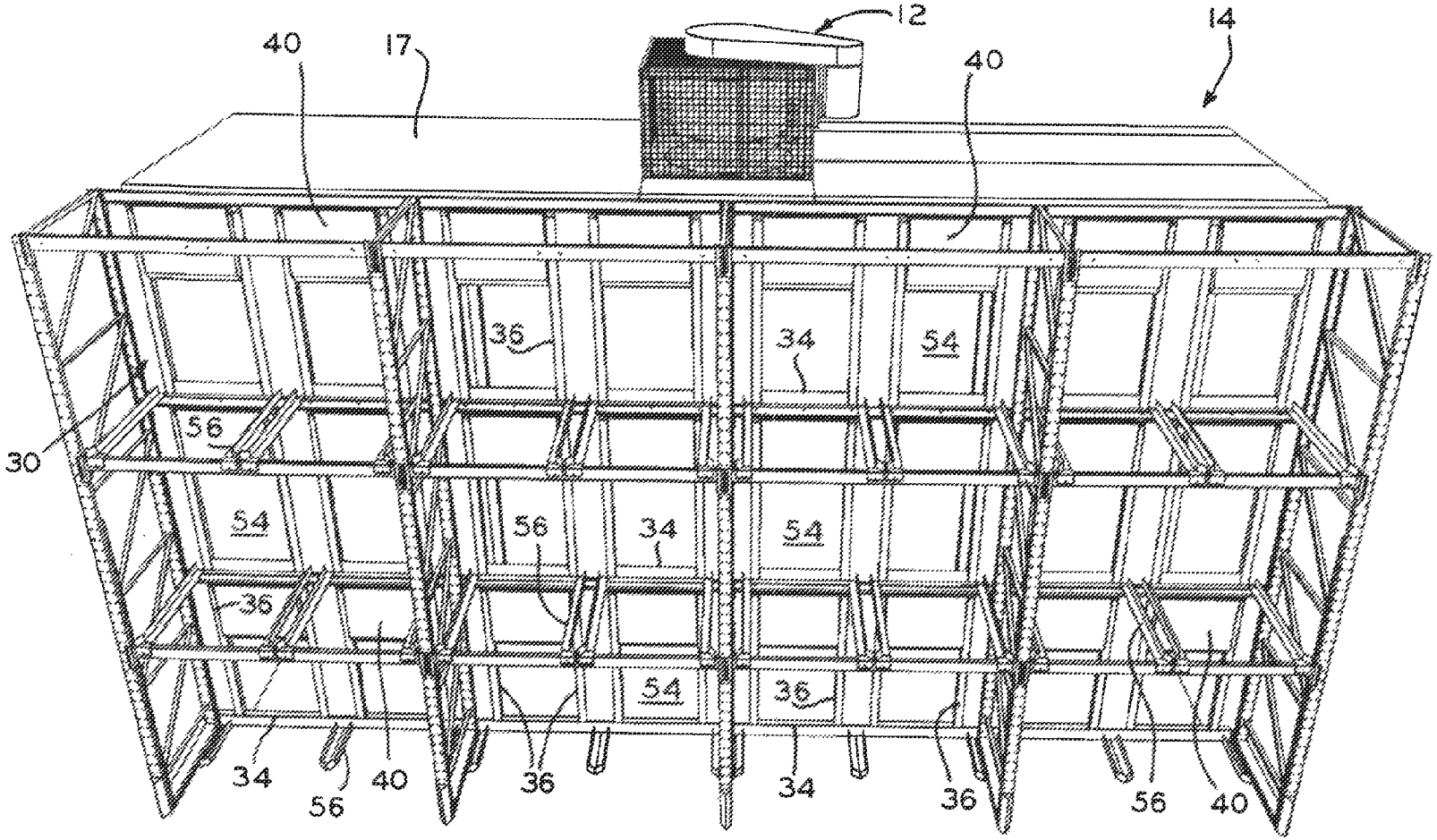
FIG. 16 is a perspective view of a portion of the racking structure accommodating twenty-four pallets on each side thereof.

Referring to FIGS. 14-15, a product stack may be positioned at a level below bottom. panel 45 of swing seal 40. In such situations, as shown in FIG. 14, filler panel 80 is attached below top horizontal frame member 38 of wall 30 such that it is disposed between top horizontal frame member 38 of wall 30 and top panel 42 of swing seal 40 to restrict any undesired passage of air into chamber 6. Brackets 62 are attached to side periphery seals 36 below filler panel 80, and swing seal 40 is attached to wall 30 via brackets 62, in the manner described above. Product stack 82 of FIGS. 14 and 15 is then at a height such that a top edge 84 of product stack 82 may interact with swing seal 40 to rotate swing seal 40 inwards towards chamber 6 (FIG. 15), as described above, creating a seal between product stack 82 and the intake opening.

Further, in the described embodiments, bottom panel 45 of swing seal 40 forms an obtuse angle with front panel 47 to form beveled bottom edge 46. The beveled edge 46 reduces the chance that the lower edge of the swing seal 40 catches onto a product stack when the stack is being pulled back from the intake opening, or being positioned against the intake opening, Beveled bottom edge 46 prevents a product stack from getting caught or hung up onto the bottom panel of the swing seal when the product stack is being pulled back from intake opening 54.

Further, if product stack 76 has a height such that top edge 84 is at a height level with beveled bottom edge 46 of swing seal 40, top edge 84 can seal against beveled bottom edge 46. This allows for a greater sealable range based on product stack height than if the bottom edge were perpendicular to front panel 47.

While this invention has been described as having exemplary designs, the present invention can be further modified within the spirit and scope of this disclosure. This application is therefore intended to cover any variations, uses, or adaptations of the invention using its general principles, Further, this application is intended to cover such departures from the present disclosure as come within known or customary practice in the art to which this invention pertains and which fall within the limits of the appended claims.

What is claimed is:

1. An installation for chilling or freezing and cold storage of product stacks of palletized product, comprising:

a cold storage warehouse space;

at least one chiller in said warehouse space that produces chilled or freezing air and maintains the temperature of ambient air in said warehouse space at chilled or below freezing;

at least one air flow chamber including opposite walls, a plurality of air intake openings in at least one wall of said walls, and at least one air outlet having an associated air moving device for causing chilled or freezing air to be drawn into said chamber through said air intake openings and exhausted into said warehouse space through said air outlet; and automatically adjustable swing seals disposed over respective said air intake openings, each said swing seal hingedly connected to said at least one wall via a hinge defining a horizontal axis about which said swing seal rotates;

whereby when a first product stack of product to be chilled or frozen is disposed in sealing engagement with a selected one of said air intake openings against a respective one of said swing seals within the selected one of said air intake openings, a first top edge of said first product stack is disposed against a front panel of said swing seal to rotate said swing seal inward about said horizontal axis of said hinge such that said swing seal and peripheral walls defining said air intake opening create a seal between said first product stack and said air intake opening, and whereby when a second product stack of product to be chilled or frozen is disposed in sealing engagement with the selected one of said air intake openings against the respective one of said swing seals, a second top edge of said second product stack is disposed against the front panel of said swing seal to rotate said swing seal inward about said horizontal axis of said hinge such that said swing seal and peripheral walls defining said air intake opening create a seal between said second product stack and said air intake opening, said first and second product stacks having varying heights, whereby chilled or freezing air is drawn through the first or second product stack to thereby quickly freeze the product regardless of the varying heights.

2. The installation of claim 1, and including a plurality of product stacks disposed against respective said openings, some of said product stacks having different heights than other of said product stacks.

3. The installation of claim 1, wherein said swing seal further comprises a pair of side panels, a top panel, and a bottom panel, said side panels, disposed around a periphery of said front panel.

4. The installation of claim 3, wherein said bottom panel of said swing seal forms a beveled bottom edge of said swing seal.

5. The installation of claim 3, wherein said hinge comprises a rod extending through said side panels of said swing seal supported by brackets attached to the wall.

6. The installation of claim 1, and including a product stack having cases positioned on a pallet, said cases separated by spacers such that air is drawn through said spacers to said air intake opening into said chamber and exhausted through said chamber via said air outlet.

7. The installation of claim 1, further comprising a filler panel disposed between a top peripheral wall of said air intake opening and said swing seal to accommodate short product stacks.

8. The installation of claim 1, wherein said swing seal rotates a first amount when said front panel is engaged with said first product stack and said swing seal rotates a second amount when said front panel is engaged with said second product stack.

9. The installation of claim 8, wherein:

said first product stack defines a first height and said second product stack defines a second height, said first height larger than said second height; and said first amount of rotation of said swing seal larger than said second amount of rotation of said swing seal.

10. An installation for chilling or freezing and cold storage of palletized product, comprising:

a cold storage warehouse space including a plurality of pallet storage bays;

at least one chiller in said warehouse space that produces chilled or freezing air and maintains the temperature of ambient air in said warehouse space at chilled or below freezing;

at least one air flow chamber including opposite walls, a plurality of air intake openings in at least one wall of said walls respectively adjacent said plurality of pallet storage bays, and at least one air outlet having an associated air moving device for causing chilled or freezing air to be drawn into said chamber through said intake openings and exhausted into said warehouse space through said air outlet; and swing seals disposed over respective said air intake openings, said swing seals respectively extending forwardly of their respective air intake openings and into the respective pallet storage bay, and being yieldably movable rearwardly away from said plurality of pallet storage bays and toward the interior of said chamber;

whereby when product stacks to be frozen or chilled are disposed in respective said plurality of pallet storage bays and in sealing engagement with said air intake openings and against said swing seals, said swing seals are pushed away from said product stacks inwardly such that said swing seal and peripheral walls defining said air intake opening create a seal between said engaged product stack and said air intake opening, whereby chilled or freezing air is drawn through said product stack to thereby quickly freeze the product.

11. The installation of claim 10, and including a plurality of product stacks disposed against respective said openings, some of said product stacks having different heights than other of said product stacks.

12. The installation of claim 10, and including a product stack having cases positioned on a pallet, said cases separated by spacers such that air is drawn through said spacers to said air intake opening into said chamber and exhausted through said chamber via said air outlet.

13. The installation of claim 10, further comprising a filler panel disposed between a top peripheral wall of said air intake opening and said swing seal to accommodate short product stacks.

14. In an installation for chilling or freezing and cold storage of stacks of palletized product, the installation including a cold warehouse space cooled by a chiller and a chamber having a plurality of air intake openings in a wall thereof, a method for chilling or freezing the stacks of palletized product, comprising:

providing a swing seal over each of a plurality of intake openings, the seals extending forwardly of the respective openings and being yieldably movable rearwardly toward an interior of the chamber;

moving a stack of palletized product against the periphery of one of the openings thereby contacting the respective swing seal and pushing the swing seal rearwardly such that the product stack is sealed along respective sides of the stack against the periphery of the opening and along a top edge of the stack against an adjacent face of the swing seal; and drawing chilled or freezing air through the product stack into the chamber and out of the chamber to thereby chill or freeze the product stack.

15. The method of claim 14, wherein the swing seal hangs downwardly over its respective opening and is hingedly mounted for rotation about a horizontal axis.

16. The method of claim 15, and moving product stacks of differing heights against respective air intake openings and contacting the respective swing seals at differing vertical positions.

17. The method of claim 14, and moving product stacks of differing heights against respective air intake openings and contacting the respective swing seals at differing vertical positions.

18. The method of claim 14, wherein engaging the product stack comprises providing a product stack having one of a first height and a second height, the second height less than the first height.

19. The method of claim 14, further comprising the step of providing a filler panel disposed between a top peripheral wall of the air intake opening and a top panel of the swing seal.

20. The method of claim 14, wherein providing the swing seal comprises providing the swing seal having a front panel including an exterior face facing exteriorly away from the chamber, the swing seal including a top panel, a bottom panel, and a pair of side panels, each top, bottom, and side panel including a thickness and respectively disposed around the periphery of the front panel.

21. The method of claim 20, wherein the seal has a beveled bottom edge.

22. The method of claim 20, wherein when the swing seal is at rest in a rest position, the exterior face of the front panel is positioned along a vertical plane spaced from the first wall and the chamber at a distance corresponding generally to the thickness of the side panels.

* * * * *